US006102206A

United States Patent [19]

Pride

[11] Patent Number: 6,102,206

[45] **Date of Patent: *Aug. 15, 2000**

[54] PACKAGING FOR PANELS, E.G. GLASS PANELS

[75] Inventor: Thomas E. Pride, Spring Green, Wis.

[73] Assignee: Cardinal IG Company, Minnetonka, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/849,539

[22] PCT Filed: Apr. 4, 1997

[86] PCT No.: PCT/US97/05652

§ 371 Date: Jun. 10, 1997

§ 102(e) Date: Jun. 10, 1997

[87] PCT Pub. No.: WO97/37907

PCT Pub. Date: Oct. 16, 1997

Related U.S. Application Data

[60] Provisional application No. 60/014,944, Apr. 5, 1996.

[51] Int. Cl.[7] ..... B65D 85/48; A47F 5/00

[52] U.S. Cl. ..... 206/454; 211/41.14

[58] Field of Search ..... 206/454, 449, 206/451, 597; 211/41.14, 85.8; 108/53.1, 55.1, 56.1; 220/6

[56] References Cited

U.S. PATENT DOCUMENTS

| | | | |
|---|---|---|---|
| 2,884,136 | 4/1959 | Leighton | 211/41.14 |
| 3,047,142 | 7/1962 | Heffley . | |
| 3,193,093 | 7/1965 | Hansen | 206/451 |
| 3,199,709 | 8/1965 | Morrison et al. . | |
| 3,402,845 | 9/1968 | Eriksson | 220/6 X |
| 3,645,387 | 2/1972 | Hunt . | |
| 3,655,034 | 4/1972 | Stollman et al. . | |
| 3,887,071 | 6/1975 | Thomaswick . | |
| 3,913,965 | 10/1975 | Muller et al. | 211/41.14 X |
| 3,955,676 | 5/1976 | Hansen et al. | 206/451 |
| 4,177,907 | 12/1979 | Funaioli et al. | 220/6 X |
| 4,278,171 | 7/1981 | Millhoan . | |
| 4,467,922 | 8/1984 | Rowley . | |
| 4,512,473 | 4/1985 | Thomaswick et al. | 206/454 |
| 4,836,379 | 6/1989 | Shaw . | |
| 4,934,538 | 6/1990 | Beyer . | |
| 5,145,073 | 9/1992 | Kitagawa et al. . | |
| 5,676,066 | 10/1997 | Cavalier et al. | 108/55.1 |
| 5,685,437 | 11/1997 | Lisec | 211/41.14 |
| 5,803,257 | 9/1998 | Bartholemew | 206/454 |
| 5,813,536 | 9/1998 | Bartholomew | 206/454 X |

FOREIGN PATENT DOCUMENTS

| | | | |
|---|---|---|---|
| 2400559 | 3/1973 | Germany . | |
| 3442992 | 11/1984 | Germany . | |
| 3442992 | 5/1986 | Germany | 206/454 |

*Primary Examiner*—Bryon P. Gehman
*Attorney, Agent, or Firm*—Fredrikson & Byron, PA

[57] ABSTRACT

A shipping container comprises a floor and an upright rear wall that intersect at approximately a right angle for vertically supporting a plurality of parallel panels such as insulating glass units, with the edges of the panels being supported by the floor and the rear wall. A plurality of elongated, elastic restraints, such as elastic cords, are carried by the container and are positioned so as to encounter a respective panel and to elastically urge that panel toward said intersection. Each elongated elastic restraint extends generally in the plane of its respective panel from the rear wall above the floor to the floor forwardly of the rear wall, the restraint contacting and elastically pressing against the upper, forward corner of the glass unit.

15 Claims, 12 Drawing Sheets

PACKAGING FOR PANELS, E.G. GLASS PANELS

This is a U.S. National application based upon PCT Application PCT/US97/05652, filed Apr. 4, 1997, which claims priority from U.S. Provisional Application Ser. No. 60/014,944, filed Apr. 5, 1996.

FIELD OF THE INVENTION

The invention relates to shipping containers and packaging for securely supporting panels such as insulating glass units.

BACKGROUND OF THE INVENTION

Insulating glass units employed in windows and doors commonly are manufactured by sandwiching a peripheral spacer between aligned, parallel sheets of glass. One such construction is shown in Larsen, U.S. Pat. No. 5,439,716. The finished units are packaged and shipped to another location in which the glass units are provided with appropriate frames to form finished windows and doors.

It may become necessary to replace the old, worn or damaged windows of a building such as a residence at the same time. In this process, all of the required unframed glass units, of varying sizes, may be produced, packaged, and shipped by one company to another which will add the appropriate frames. For efficiency and economy of manufacture, insulating glass units may be vertically stacked or packaged serially with respect to one another in a particular order as determined by the company that does the framing. In the framing operation, frames are provided in the same order and are automatically matched with the appropriately sized glass units as the glass units are serially removed from their shipping container. Thus, the glass units desirably are arranged in a shipping container in accordance with the needs of the company that provides the frames; this, in turn, may require large glass units to be packaged directly adjacent smaller units.

A problem arises when a stack of glass units is transported. It is difficult to package the stacked glass units so that smaller units, which may be sandwiched between larger units, are supported against breakage. When the glass units are transported, as by truck, the vertically held glass units are subjected to substantial bouncing and jolting. The smaller glass units thus can move with respect to the larger units, and substantial breakage can result. If the glass units are stacked against one another so that they either touch each other or are separated by paper or cardboard spacers, the resulting stack may be wrapped with a heat-shrinkable plastic film or the like in an attempt to hold the stack together and prevent the individual glass units from moving with respect to one another. If the stack is wrapped loosely, movement of the smaller glass units with respect to the larger units may yet occur, with consequent breakage. However, if the stack is wrapped tightly, the size disparity of the units may lead to breakage as edges of the smaller units are pressed laterally into the unsupported center areas of the larger units.

To support vertically aligned glass sheets against breakage during transportation, various containers have been proposed. One such container comprises a floor, an end wall supported at right angles to the floor, and a series of parallel rods extending from an upper edge of the wall to a lower, forward edge of the floor, the rods being spaced from one another by a distance enabling glass sheets to be inserted between the rod pairs. Although containers of this type are appropriate for conveying vertically aligned glass sheets for very short distances, as across the flat floor of a factory, they are quite inadequate to support glass units against breakage during shipment when the containers are subjected to bumps and jolts, since the individual glass units can move upwardly and forwardly parallel to their planes as well as from side-to-side. The container itself, as described, can be wrapped horizontally with a heat-shrinkable plastic film in an effort to stabilize the sheets, but if sheets of different sizes and shapes are intermingled, only the larger sheets will be supported.

It is an object of the invention to provide a shipping container for vertically positioned glass units in which each glass unit is supported against movement in its plane.

It is another object of the invention to provide a transport container for vertically positioned planar articles such as glass units which not only supports each of the articles against movement in its plane, but in addition enables articles of varying sizes and shapes to be positioned next to one another in a predetermined order to facilitate subsequent framing or other manufacturing operations.

It is yet another object of the invention to provide a shipping container for vertically positioned planar articles in which each of the articles is individually supported against movement in its plane and can be individually and easily inserted into and removed from the container without disturbing the other articles.

BRIEF DESCRIPTION OF THE INVENTION

For brevity, the invention will be described in connection with insulating glass units, but it will be understood that the invention is applicable to planar or sheet-like articles in general such as framed windows and doors, paintings and decorative panels, and the like.

A shipping container of the invention comprises a floor and a generally upright rear wall. The floor and rear wall lie in respective planes that intersect at approximately a right angle for vertically supporting a plurality of parallel glass units with the edges of the glass units being supported by the floor and the rear wall. The glass units thus are supported in planes that are perpendicular to the planes of the rear wall and the floor. The rear wall preferably is tipped rearwardly slightly from the vertical, e.g., through about five degrees, while maintaining its right angle orientation with the floor, so that glass units in the container will be urged by gravity in the direction of the above mentioned intersection. Elastic restraining means comprising a plurality of elongated, elastic restraints, such as elastic cords, are carried by the container. Each elastic restraint is positioned so as to encounter a glass unit and to elastically urge that glass unit toward said intersection. That is, each elastic restraint is so positioned as to exert against a respective glass unit a force having a first vector that urges the glass unit toward the rear wall and a second vector urging the glass unit toward the floor. In a preferred embodiment, each elongated elastic restraint extends generally in the plane of its respective glass unit from the rear wall above the floor to the floor forwardly of the rear wall, the restraint contacting and elastically pressing against the upper, forward corner of the glass unit. Most preferably, one end of the restraint is anchored at or adjacent the top of the rear wall, the restraint extending at an angle downwardly and forwardly over and in contact with a glass unit with the other end of the restraint being attached to the floor forwardly of the glass unit.

Preferably, the rear wall includes a glass unit contact surface comprising a plurality of spaced, generally vertically extending grooves shaped and sized to receive and support rearward edges of parallel glass units having a range of widths and sizes. Moreover, each elongated elastic restraint preferably also is provided along its length with a support block adapted to contact the forward, upper corners of a respective glass unit, the spacer means serving to transmit force to the glass unit and to appropriately space and support that glass unit with respect to adjacent glass units. In addition, the floor also desirably includes a glass unit contact surface comprising a plurality of spaced, generally horizontally extending grooves shaped and sized to receive and support the bottom edges of parallel glass units having a range of widths and sizes. The rear wall and floor preferably are carried by a framework including a hinge enabling the floor and rear wall to be pivoted toward each other into a folded position for storage.

DESCRIPTION OF THE PREFERRED EMBODIMENT

Figure 1:
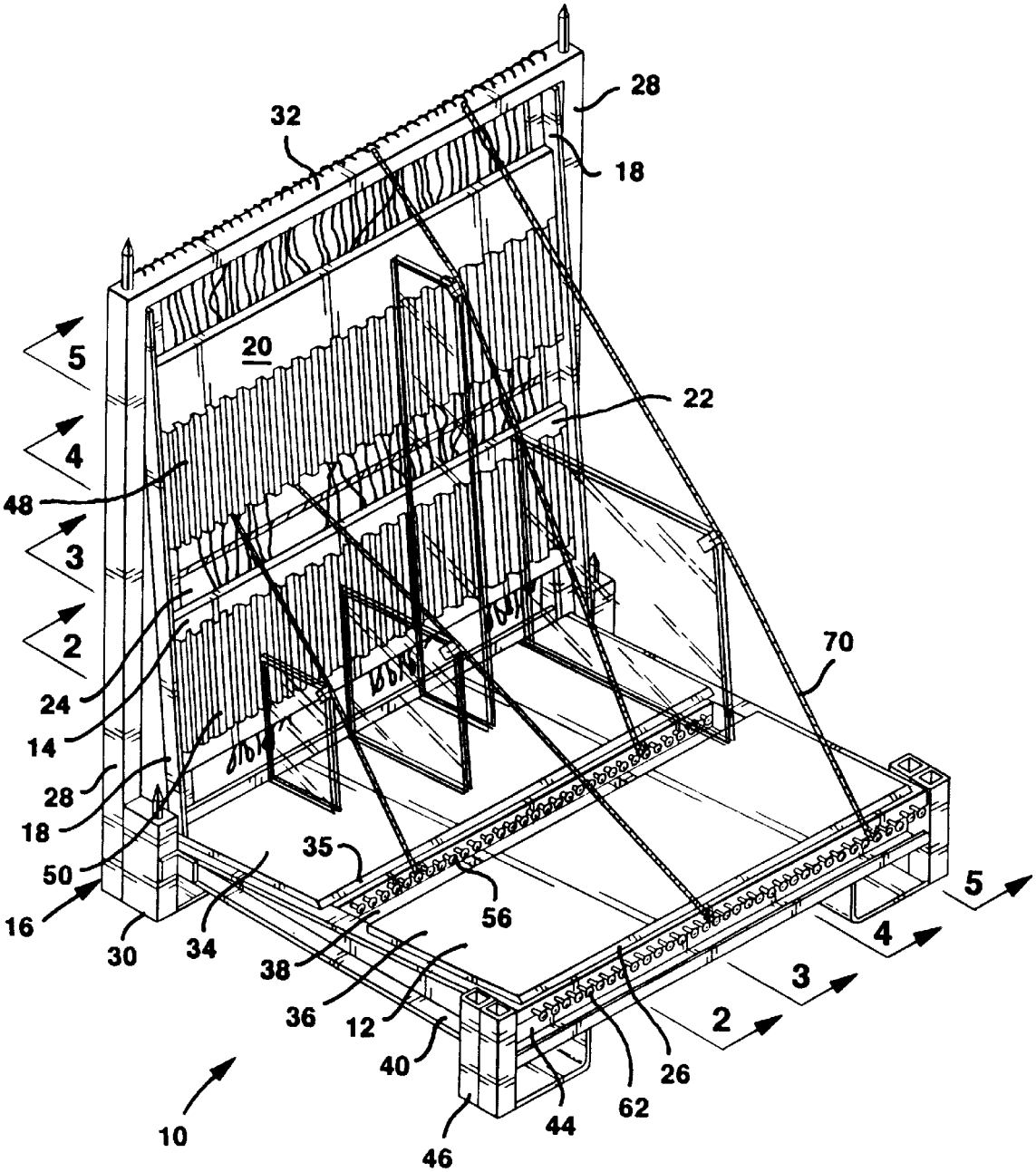
FIG. 1 is a perspective view of a device of the invention, shown holding glass units of various sizes.

A shipping container of the invention is shown in FIG. 1 as 10, the device containing a floor 12 and a rear wall 14. As shown, the floor and rear wall are supported by a generally rectangular tubular metal framework 16 comprising tubular metal lengths having generally rectangular profiles.

Rear wall 14 is supported by side braces 18, and comprises a pair of vertically spaced panels 20, 22 which lie in same plane and which have between them a horizontal, transversely extending space 24. It will be noted that the rear wall is tilted rearwardly slightly from the vertical, and that the floor is canted upwardly slightly from the horizontal as it extends forwardly toward its forward edge 26 so that the rear wall and the floor lie in planes that intersect at substantially a right angle. A generally rectangular metal outer frame 28 supports the rear wall at its upper end and extends generally vertically downwardly. At its lower ends, the generally vertical portions of frame 28 terminate in feet 30 for supporting the rear wall and maintaining the floor 12 above the floor surface of a factory or the like upon which the unit 10 stands. The rear wall 14, at its lower end, is spaced forwardly of the vertical frame members 28 to cause the rear wall to tilt backwardly slightly, as earlier discussed. The frame 28 includes an upper cross member 30.

In a manner similar to the wall 14, the floor 12 desirably is formed of two panels 34, 36 which are spaced from each other in the plane of the floor to provide a transversely extending opening 38 between them. The rear floor panel 34 is supported by a horizontal metal frame 40 from which arise brackets 42, the frame 40 being attached at its rearward end to the feet 30. The front floor panel 36 similarly is supported rearwardly by the frame 40 through brackets 43 and forwardly by a tubular cross member 44, itself supported on feet 46.

Figure 8:
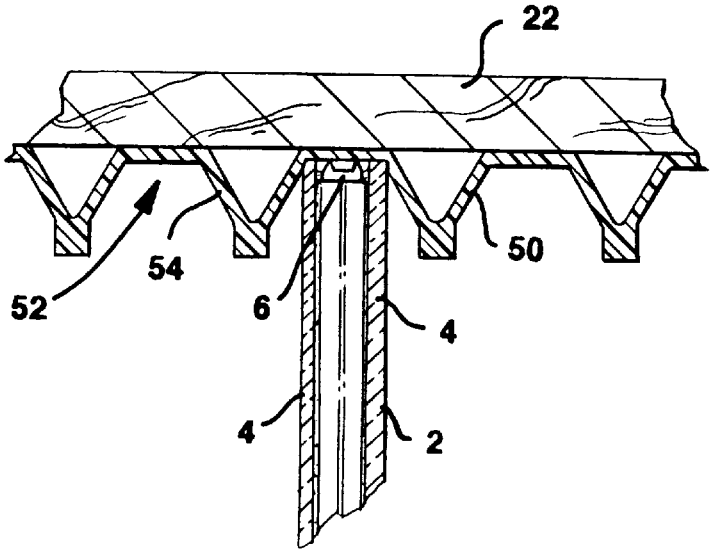
FIG. 8 is a cross sectional, broken away view taken along line 8—8 of FIG. 7.

Grooved panel units 48, 50 are mounted to the forward face of the rear wall top and bottom panels 20, 22 respectively. The grooved units are shown best in FIG. 8, and desirably are formed from sheets of a slippery, soft plastic such as polyethylene or other non-stick polymer to which sealants of the type that may be used in the construction of glass units do not readily stick. The groves 52 are generally vertically aligned, and are sized and shaped to receive the edge of a glass unit 2. Preferably, each groove is formed, as shown in FIG. 8, with a pair of confronting walls 54 which have rearwardly converging portions (to urge the panes of a glass unit toward each other and to minimize contact with sealant materials along the edges of glass units), and forwardly extending parallel sections to securely hold glass units of varying widths. The grooves are spaced apart a sufficient distance to space the parallel glass units from one another and to accommodate a support block (described below). The function of the grooves 52 is to engage and support glass units in a spaced configuration across the transverse width of the container 10. Upper surfaces of the floor panels 34, 36 need not be grooved, although grooves can be provided if desired. Rather, the edges of the glass units may rest directly upon the floor panels 34, 36 (which desirably are wooden). The floor preferably is provided with a glass unit contacting surface of polyethylene or other polymeric material to which polymeric sealants such as silicones that are applied about the edges of some glass units will not tenaciously adhere. Most preferably, narrow strips or laths (shown at 53 in FIGS. 18–20) having upper surfaces of polyethylene or similar non-stick material are laid transversely across the floor generally parallel but spaced from each other, and the bottom edges of the glass units are supported upon these laths. To insure that the glass units do not have freedom to move from side to side across the floor, it is also preferred to utilize grooved panels on the floor such as the panels 55 depicted in FIGS. 18–20. In this embodiment, the panels 55 include a floor portion 57 of a height less than the height of the strips 53, as shown best in FIG. 18. Arising from the floor portion 57 are a plurality of spaced blades 59 that define grooves between them sized to receive the bottom edges of the glass units, these grooves being aligned with the grooves 52 carried by the back wall. Preferably, the bottom edges of the glass units rest upon the strips 53, and thus are spaced slightly above the floor portion 57.

Figure 11:
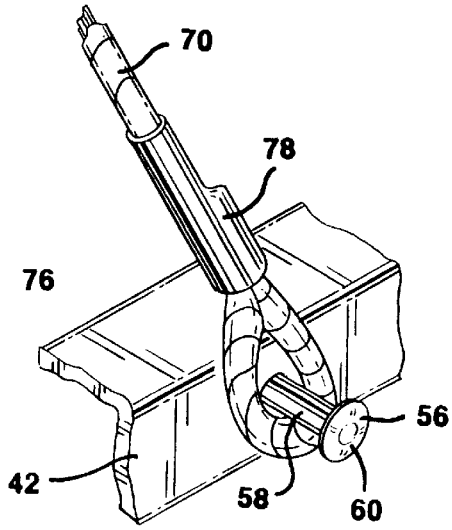
FIG. 11 is a cross sectional, broken away view showing the attachment of an elongated, elastic restraint to the floor of the device of FIG. 1.

In the embodiment shown in FIGS. 1–5, the bracket 42 at the forward edge 35 of the rear floor panel 34 has a plurality of knobs 56 protruding forwardly from its surface, as shown best in FIG. 11. Each knob includes a short shank 58 and a head 60 of greater diameter. The knobs are spaced from one another transversely along the width of the bracket 42, each knob corresponding to one of the grooves 52 in the grooved wall units 48, 50. Similar knobs 62, also in transversely spaced respective alignment with the grooves 52, extend forwardly from the front edge of the front frame cross member 44.

Elongated elastic restraints are typified as elastic stretch cords of the type often used with exercise equipment and as elongated rubber tubes or straps known commonly as "bungee" cords. The elongated elastic restraints can take a number of forms, including helical spring-mounted inelastic cords, stretchy braided polymeric ropes of nylon or the like, etc. The elastic elongated restraints are capable of resiliently imparting a supporting force to glass units carried in the container of the invention, in a manner typified in the following description.

Figure 9:
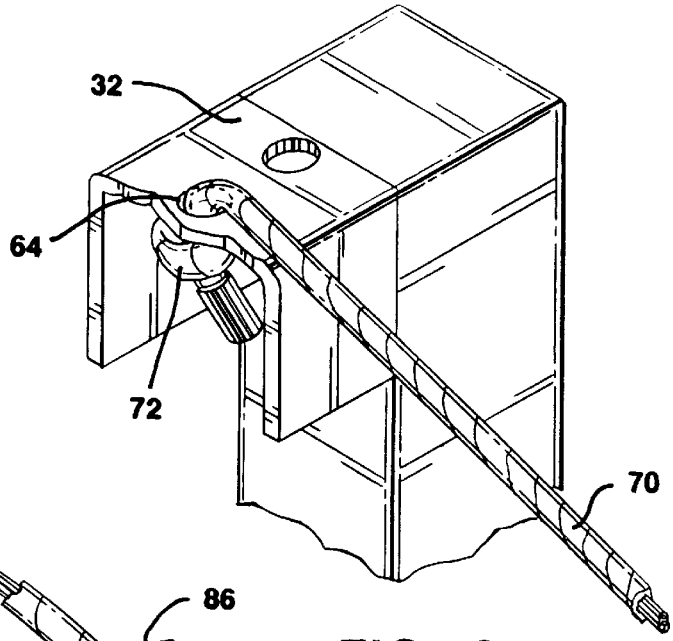
FIG. 9 is a broken away, cross sectional view showing a portion of the device of FIG. 1.
Figure 12:
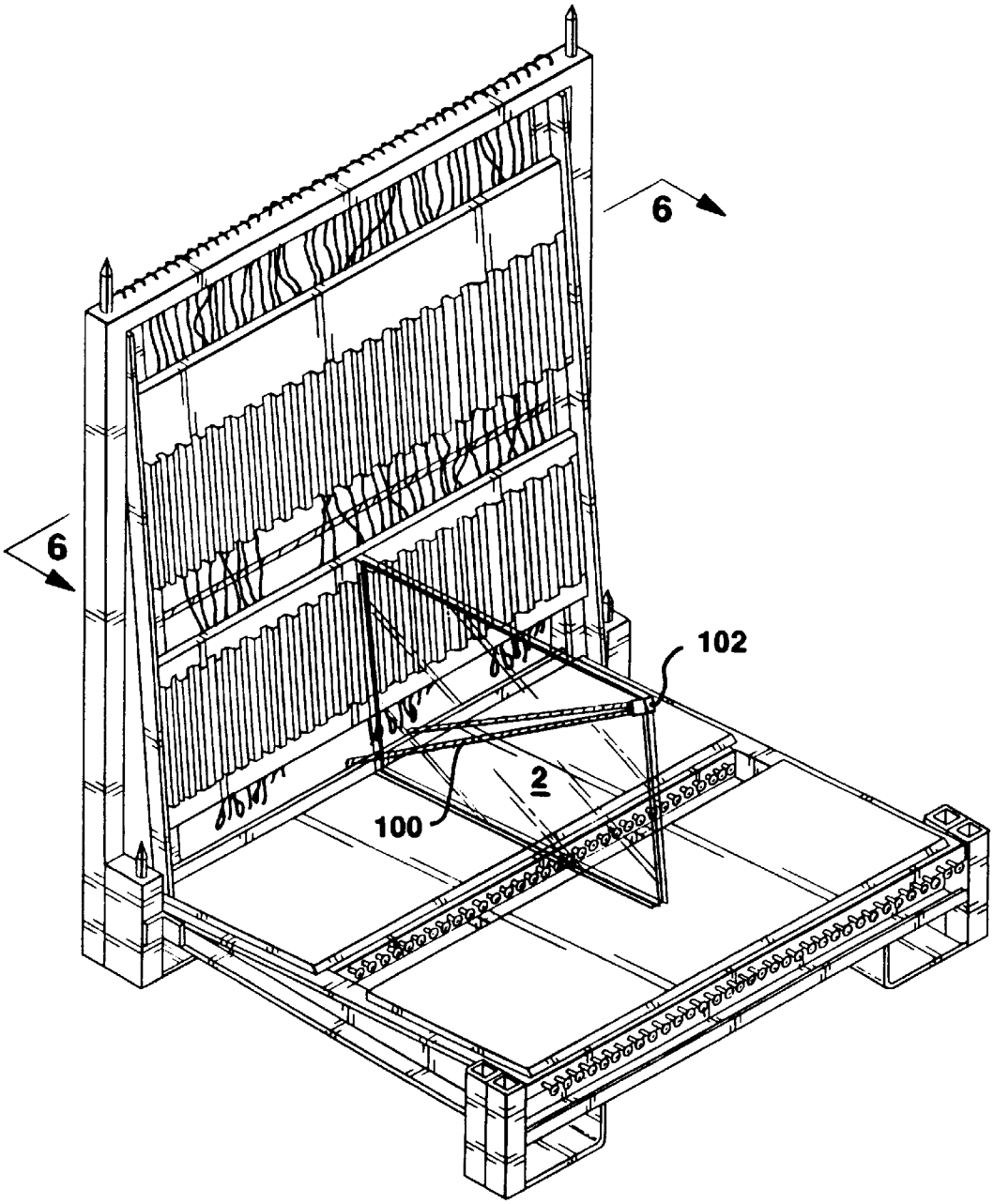
FIG. 12 is a perspective view of a modified device of the invention shown holding a single grass unit.

With reference to FIG. 1, a plurality of elongated elastic restraints, exemplified as stretch cords 70 of the type employed in exercise equipment, are provided. One end of each cord 70 is secured to the frame upper cross member 32, as shown best in FIG. 9, the cord passing through a hole 64 formed in the upper wall of the cross member 32 and terminating in a knot 72 preventing the cord from being withdrawn through the hole 64. At its other end, each stretch cord contains a loop 76 as shown best in FIG. 11, the end of the stretch cord being held in the loop configuration by means of a tape 78 or other fastener. Note that the loop 76 is sized to slip easily over the heads 60 of the knobs 58, as shown in FIG. 12.

Referring now to FIG. 8, insulating glass units 2 commonly have a pair of generally rectangular glass panes 4 that are spaced from one another by a peripheral spacer 6. A bead of adhesive material may be placed between the edges of the spacer 6 and the confronting pane surfaces to adhere the panes and spacer into a self-supporting unit. A separate bead of polymeric material may be placed between the glass panes outwardly of the spacer to provide further strength or moisture resistance. Other glass units may have other structures, of course, and it should be understood that the invention is not limited to any particular glass units. It is important that the glass panes not be exposed to edge forces that would tend to separate the panes, and for this purpose, the elongated elastic restraints of the invention may include support blocks as exemplified in FIGS. 10 and 13–17.

Figure 10:
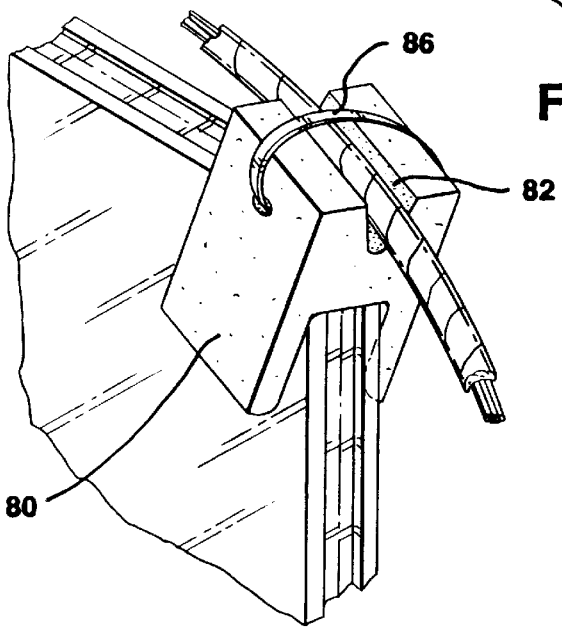
FIG. 10 is a broken away view showing structure for supporting the corner of a glass unit.
Figure 13:
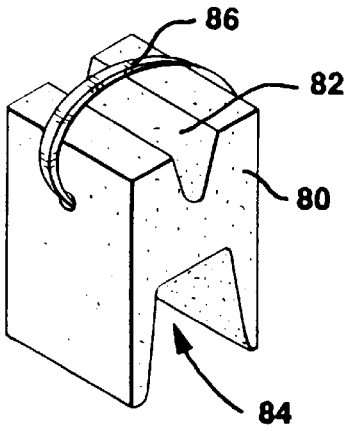
FIG. 13 is a perspective view of a support block of the invention.

The support block of FIG. 10 is shown also in FIG. 13 and comprises a block 80 of resilient material such a polyurethane foam or polyethylene, the block having a groove 82 formed in its upper surface to receive the stretch cord 70 and having a recess, exemplified as groove 84, formed in its lower surface shaped and sized to receive and support the corner of a glass unit in the manner shown in FIG. 10. A thin plastic retaining band 86 passes through a hole formed in the support block and extends over the groove 82 to attach the block to the stretch cord while permitting the block to be adjusted along the length of the cord.

FIGS. 1–5 show how glass units of varying dimensions can be individually supported in the container of the invention. Although only four glass units are shown in the container of FIG. 1, it will be understood that the container can hold as many glass units as there are grooves and stretch cords.

Figure 6:
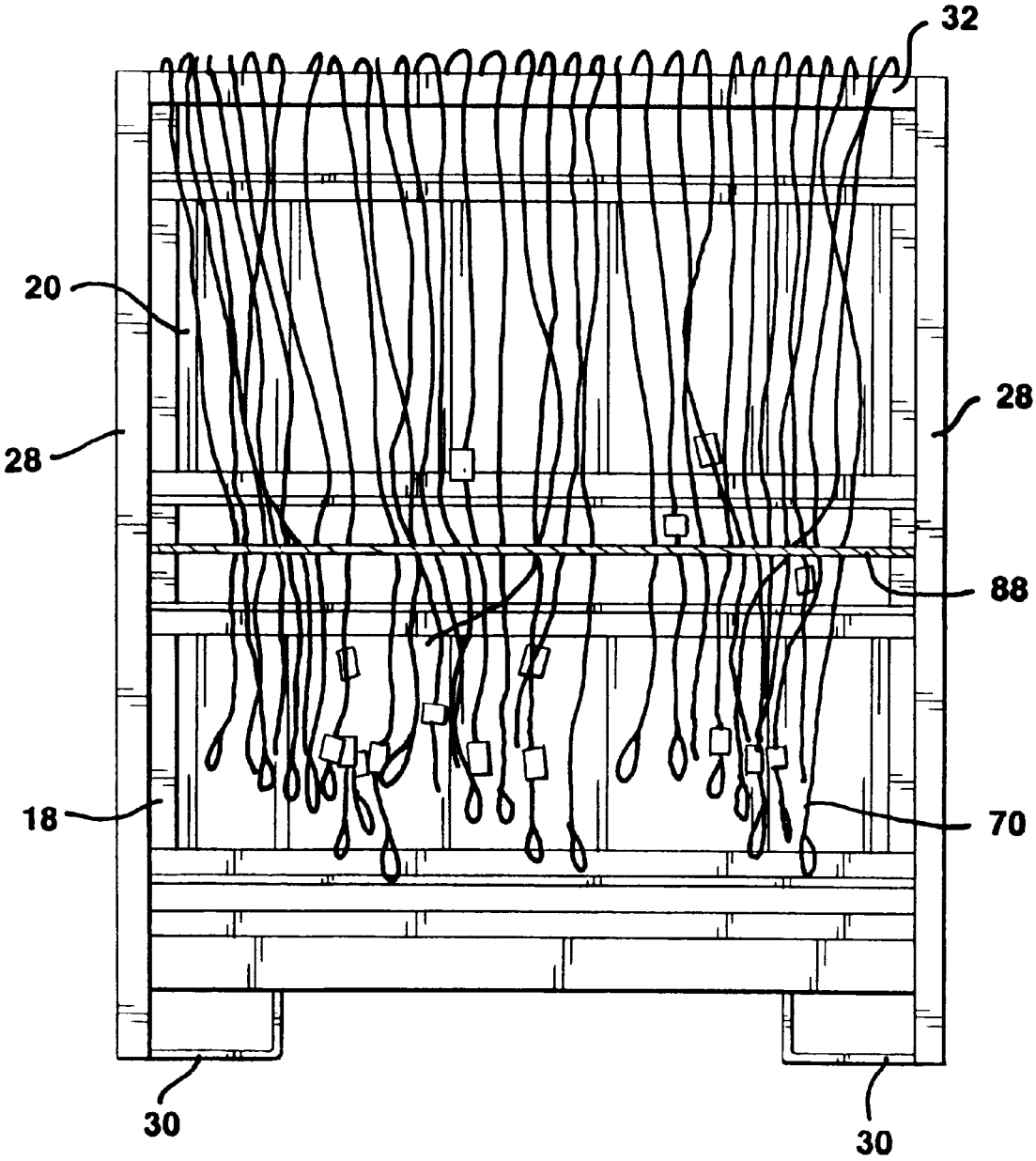
FIG. 6 is a rear view of the device of FIG. 1.
Figure 7:
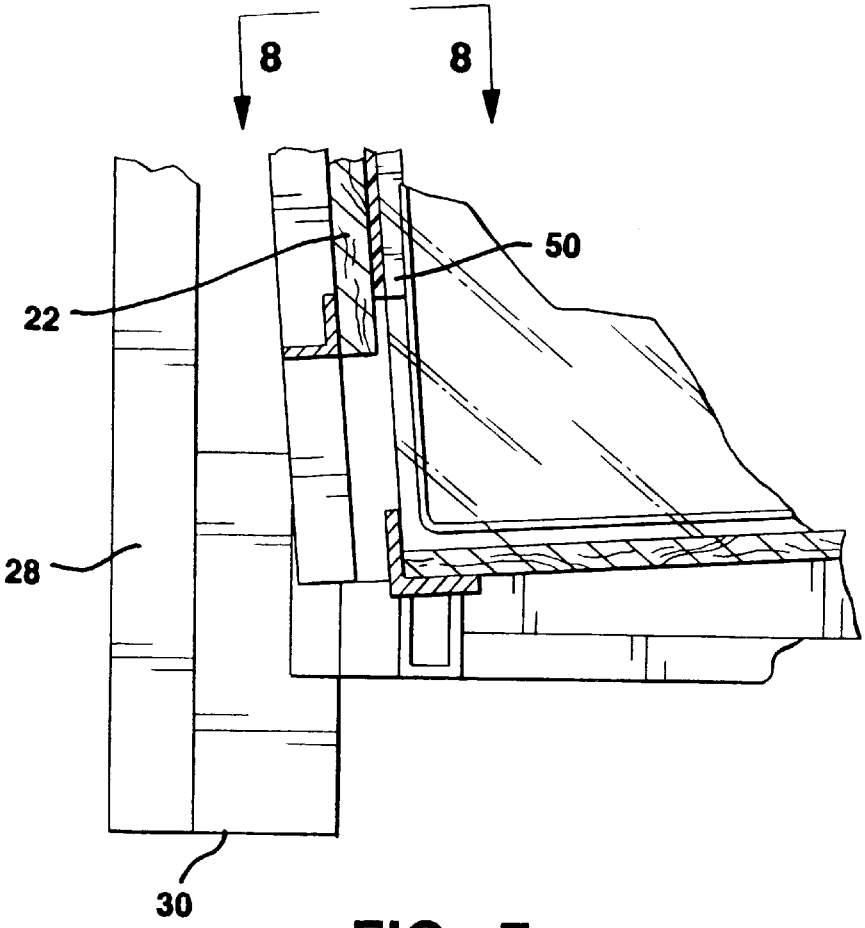
FIG. 7 is a broken away, cross sectional view of a portion of the device in FIG. 1.

When a glass unit of any appropriate size is placed in the container of FIG. 1, the stretch cord that is aligned with that glass unit is stretched over and into contact with the upper, forward corner of the glass unit with the lower end of the stretch cord then being fastened to an appropriate knob. In a preferred embodiment, the stretch cords are all of approximately the same length, and when not in use can hang vertically behind the rear wall, as shown in FIG. 6. Here, an additional stretch cord 88 is stretched transversely between the frames 28 over the stretch cords to hold the stretch cords in a stored position.

Figure 2:
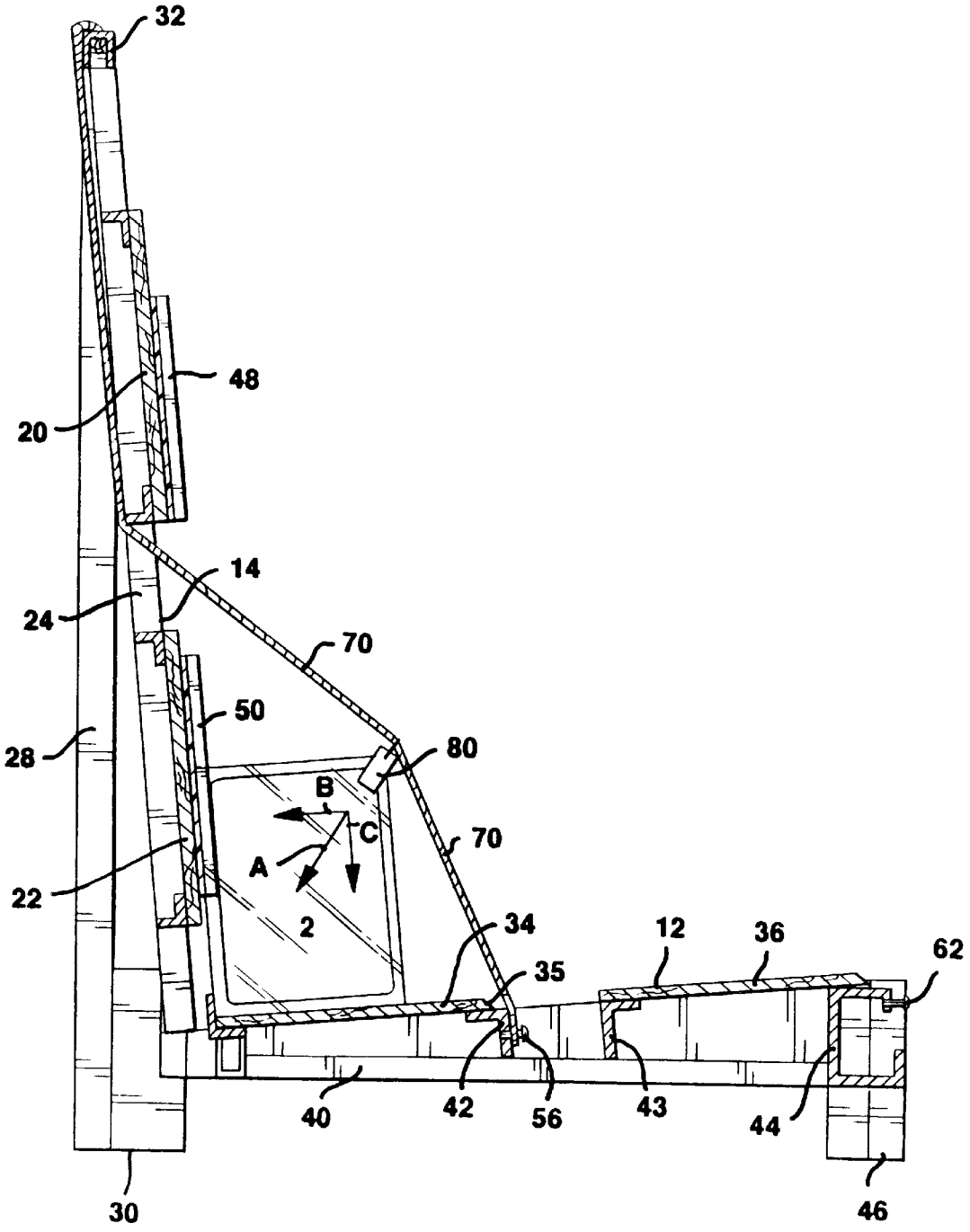
FIG. 2 is a cross sectional view taken along line 2—2 of FIG. 1.

Returning to FIGS. 1–5, the container of the invention has sufficient flexibility to enable the stretch cords to appropriately fit substantially all commercially important glass unit sizes. With reference to FIG. 2, a very small glass unit 2 is shown with a side edge captured in a groove of the grooved wall unit 50 and its bottom edge supported against the rear floor panel 34. In FIG. 2, the stretch cord 70 passes behind the upper rear wall panel 20 and thence forwardly through the space 24 between the upper and lower rear wall panels 20, 22, the lower looped end of the stretch cord being captured by a knob 56 carried by the bracket 42. The support block 80 is adjusted along the length of the stretch cord so as to come into contact with the upper, forward corner of the glass unit 2, the stretch cord being in tension at this point so as to bend through contact with the glass unit corner. Note that force is exerted on the glass unit 2 generally in the direction of the arrow A toward the intersection of the planes of the rear wall and floor. The force has vectors represented by arrows B and C urging the glass unit toward the rear wall and the floor, respectively.

Figure 3:
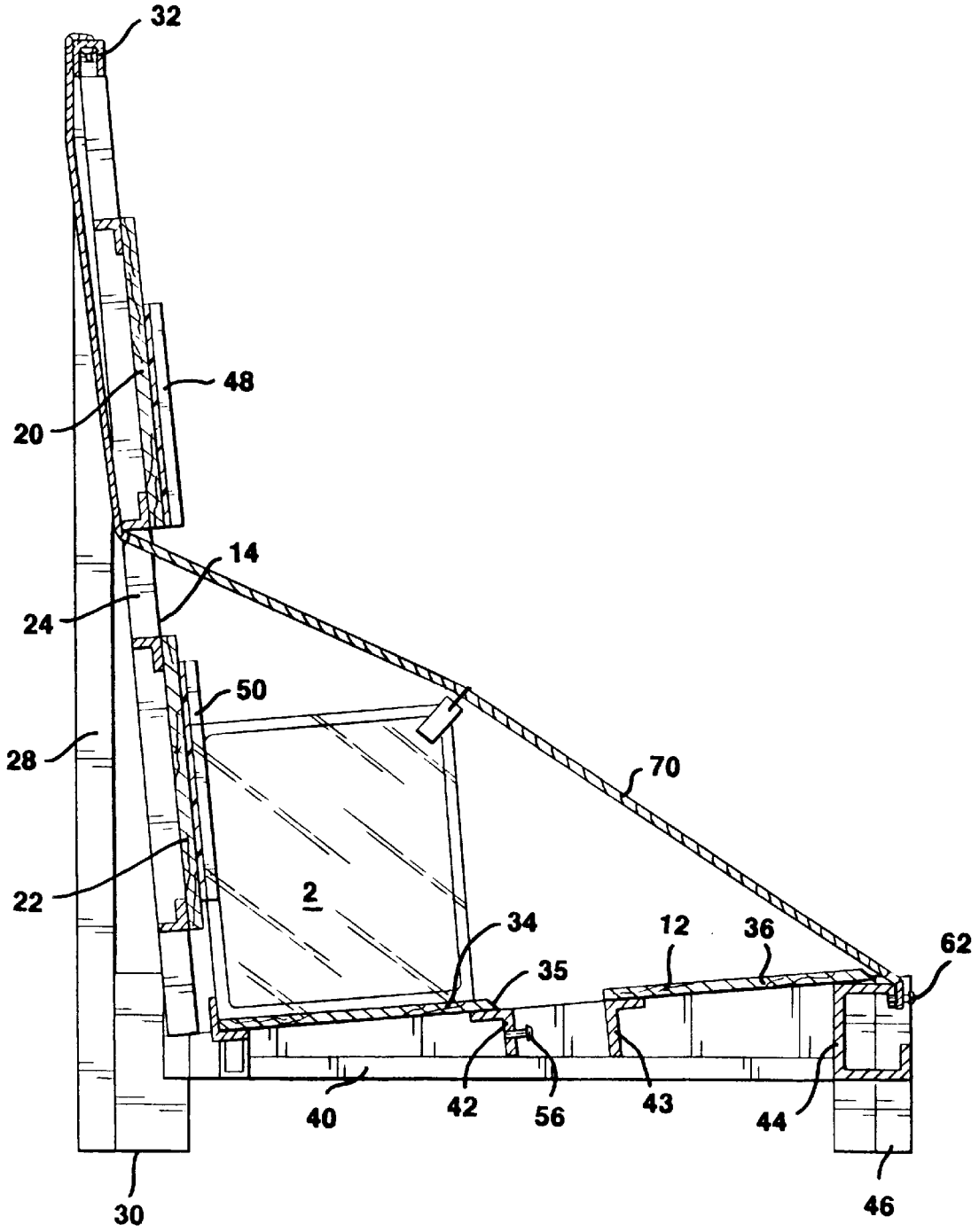
FIG. 3 is a cross sectional view taken along line 3—3 of FIG. 1.
Figure 4:
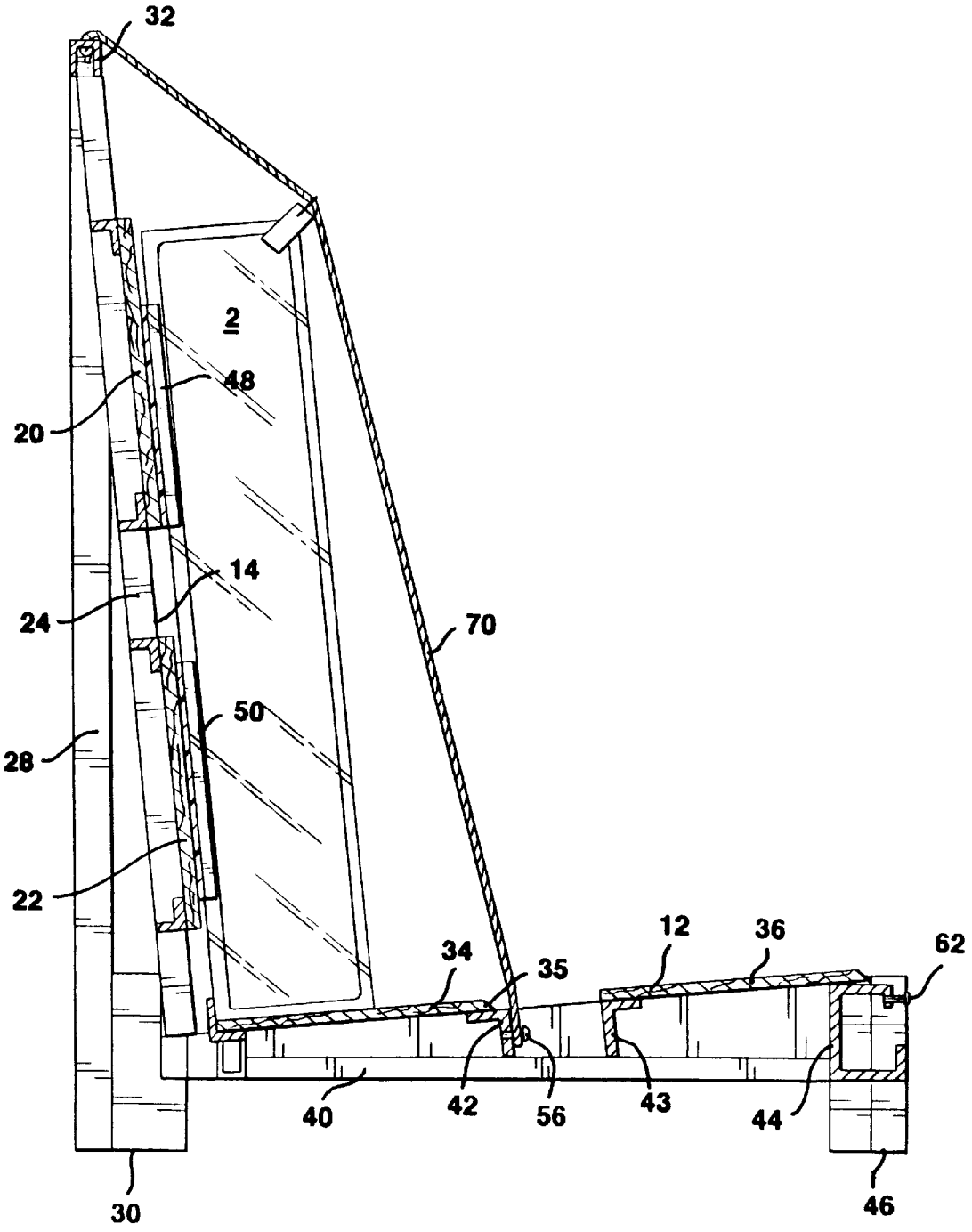
FIG. 4 is a cross sectional view taken along line 4—4 of FIG. 1.
Figure 5:
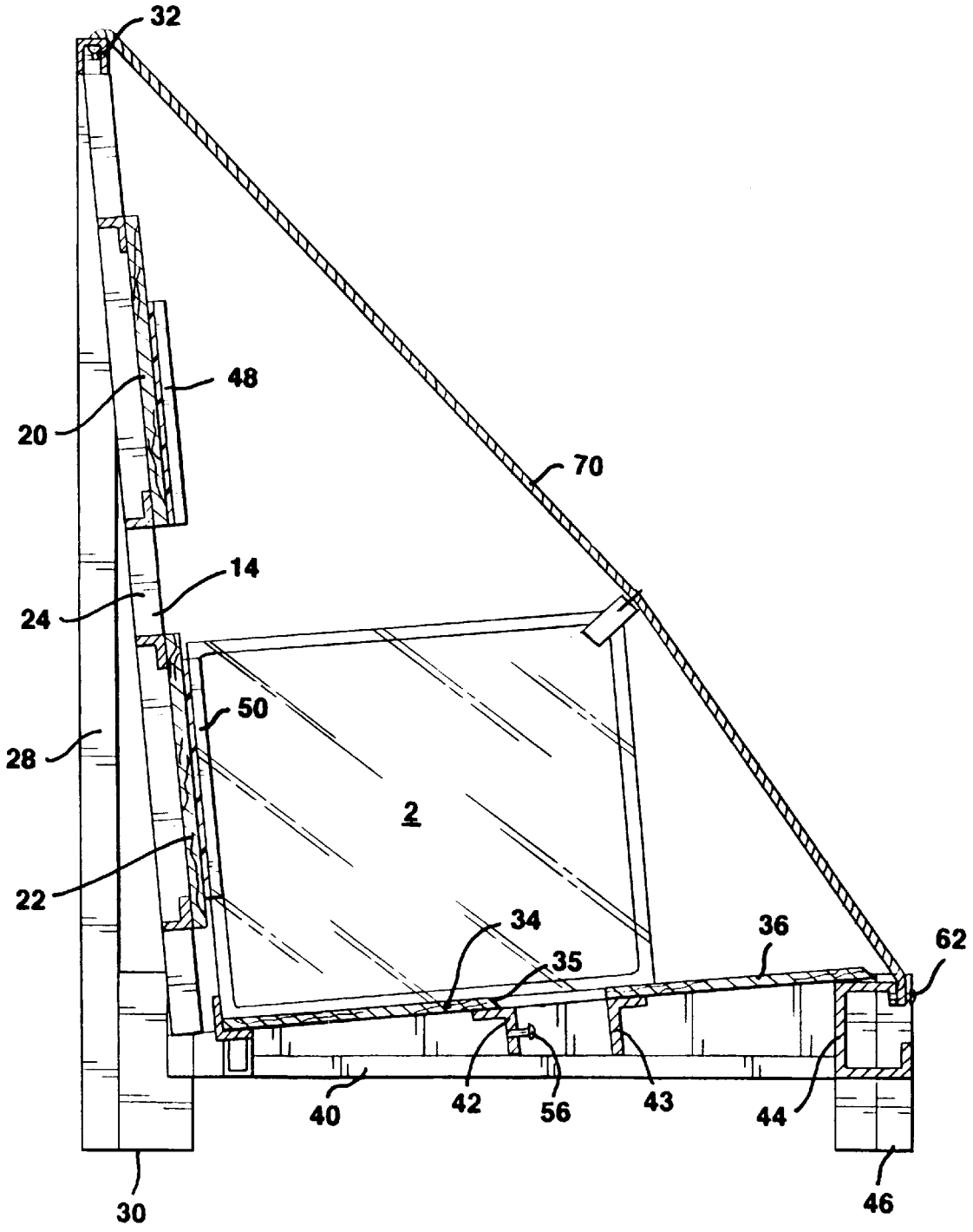
FIG. 5 is a cross sectional view taken along line 5—5 of FIG. 1.

FIG. 3 depicts restraint of a glass unit 2 that is somewhat larger than that shown in FIG. 2. Here, the looped end of the stretch cord extends forwardly through the space 24 and is looped over a knob 62 carried by the crossbeam 44. FIG. 4 depicts a long, narrow glass unit 2 supported in the container. Here, the stretch cord 70 extends forwardly from the upper cross member 32 with the lower, looped end of the cord being captured by knob 56 carried by the bracket 42. In FIG. 5, a glass unit 2 of somewhat larger dimensions than that of FIGS. 2 and 3 is positioned in a container of the invention, and here the stretch cord 70 extends forwardly from the cross member 32 to the crossbeam 44 at the front edge of the floor.

FIGS. 1–5 illustrate that the stretch cord 70 can pass behind the upper rear wall sheet 20 and then extend forwardly through the space 24 (FIG. 2), or can extend directly forwardly from the upper cross member 32 (FIG. 4). Moreover, the lower looped end of the stretch cord may be received about the knobs 56 or the more forwardly positioned knobs 62. In this manner, the stretch cord can be tensioned appropriately for each glass unit size. For a glass unit having a particularly large dimension such that it extend beyond the top of the rear wall or beyond the forward end of the floor, the stretch cord may be trained over two adjacent corners of the unit, support blocks being employed for each of these corner. For example, assume that the glass unit 2 of FIG. 4 extends upwardly above the upper cross member 32. The stretch cord in this example would be trained to extend upwardly and forwardly over the upper rear corner of the glass unit (using an appropriate support block), and then forwardly over the upper forward corner of the unit and downwardly as shown in this Figure for attachment to the floor by knobs 56. As needed, additional lengths of stretch cord may be added to accommodate unusually large glass units.

Referring again to FIG. 1, the containers of the invention may be produced in modular or adjustable form. By way of illustration, the rear wall may be provided in sections that may be mounted to each other, each section, for example, containing one of the panels 20, 22. The vertical frame members, if desired, may be formed in two or more lengths in a telescoping relationship so that the height of the rear wall may be adjusted as needed and then locked in place, as by set screws or locking pins. Moreover, it will be noted that the containers, when empty, can be nested together to facilitate transporting them to their next destination. When loaded with glass units, the containers can be mounted vertically upon each other with upstanding mounting pins on the frame of one container being received in downwardly open holes in the frame of the container above it. Here, a pair of L-shaped mounting bars (not shown) may each be mounted at its ends to an upper end of the rear wall and to a forward end of the floor to form with the container a parallelepiped, stackable shape.

Figure 18:
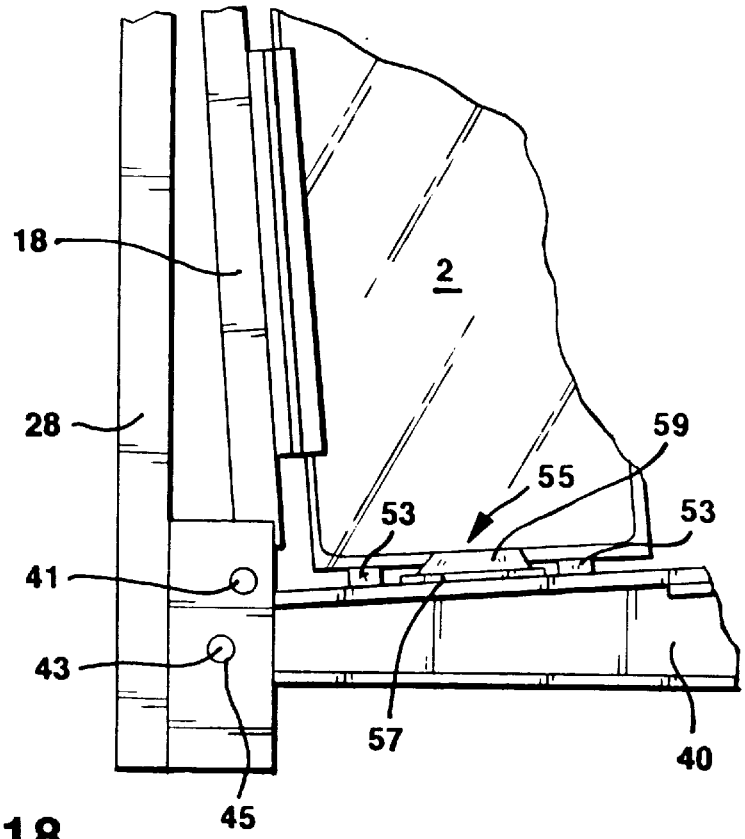
FIG. 18 is a broken-away view of a modified device of the invention.
Figure 19:
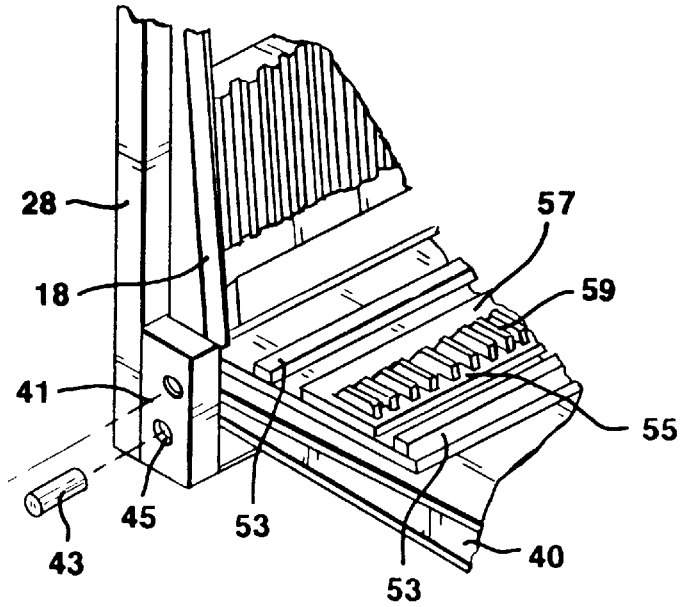
FIG. 19 is a broken-away perspective view of the device of FIG. 18.
Figure 20:
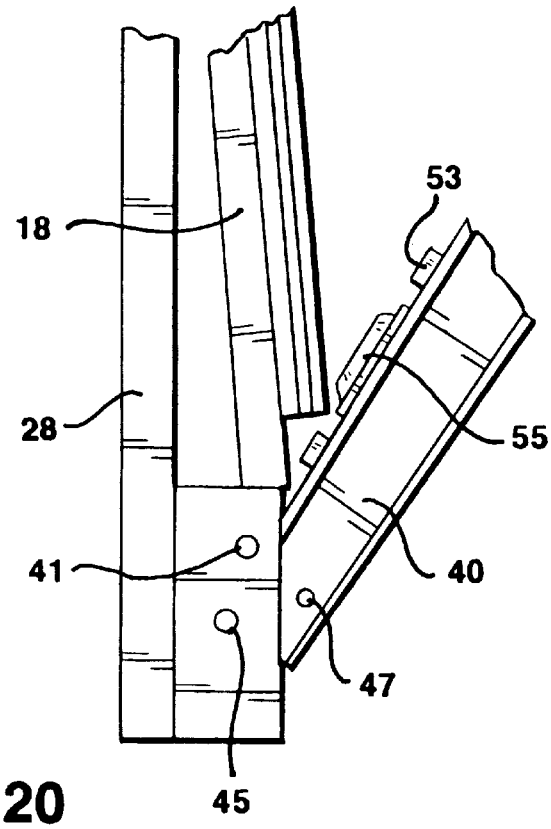
FIG. 20 is a view similar to that of FIG. 18 but showing the device in a partially folded up position.

FIGS. 18–20, in which similar numerals have been used to designate similar parts, illustrate another way in which containers of the invention may be stored when not in use. Here, the vertical and horizontal frames 18, 40 are hinged together adjacent their intersection. In these figures, the hinge is exemplified as having a hinge pin 41 that passes horizontally through aligned hinge apertures carried by the frame members 18, 40, although any hinge mechanism may be employed. In this example, a locking pin 43 is employed to maintain the floor and wall elements at right angles to each other when is use, the pin 43 extending through a hole 45 in the framework supporting frame 18 and thence through hole 47 (FIG. 20) in frame 40. When the container is to be folded for storage or transportation when not in use, the locking pin is removed, and the floor and rear wall are folded toward one another. If desired, the locking pin 43 may be reinserted in the hole 47 so as to come into contact with the forward wall of the framework and thus prevent the container from accidentally unfolding.

Figure 14:
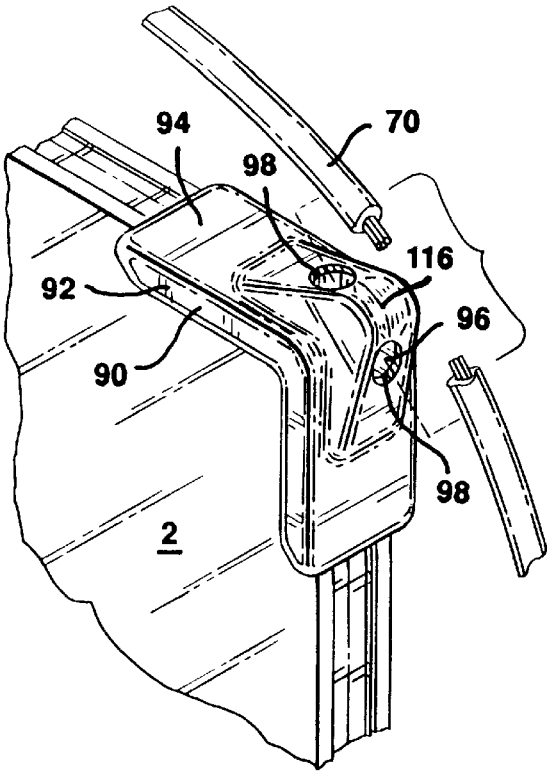
FIG. 14 is a broken away, perspective view of a modified support block shown in contact with the corner of a glass unit.
Figure 22:
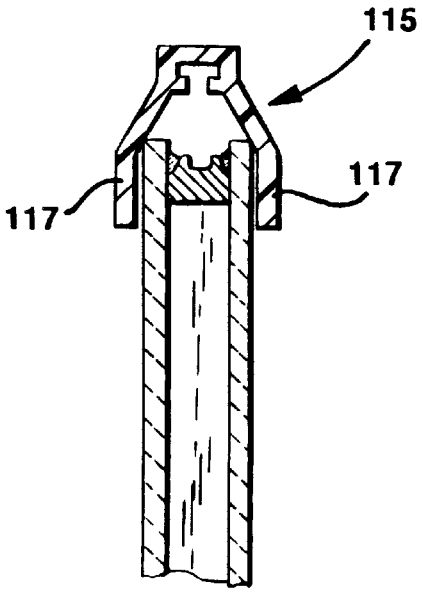
FIG. 22 is a broken-away, cross section view taken along line 22—22 of FIG. 21.
Figure 21:
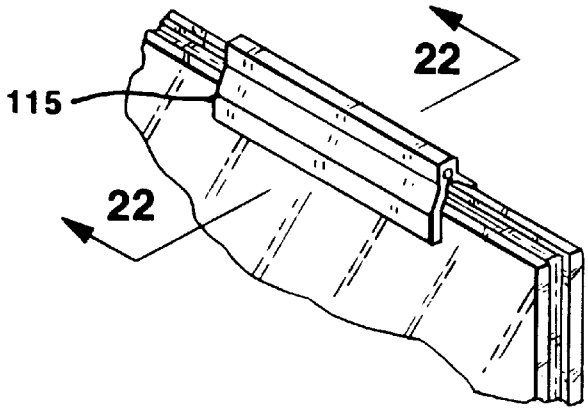
FIG. 21 is a broken-away perspective view of an edge of a glass unit having a protective sheath.

Turning now to FIGS. 10 and 13–17, the support blocks of the invention preferably are sufficiently rigid so that even when they are pressed downwardly with substantial force upon the corner of a glass unit, as shown in FIG. 10, there is no tendency of the glass panes to separate from the peripheral spacer between them. In a preferred embodiment, the support block is designed instead to gently press the edges of the panes together. Reference is made particularly to FIG. 13 in which the confronting surfaces of the walls forming the bottom groove 84 converge upwardly so that as the block 80 is pushed down more firmly upon the glass unit, edges of the glass unit are urged toward one another. Those skilled in the art will understand that various other configurations for support blocks can be employed as well. One such support block is shown at 90 in FIG. 14. Here, the support block 90 comprises a U-shaped channel, the legs 92 of which are spaced sufficiently to receive a glass unit 2 between them, as shown. The channel is bent through 90 degrees so that the outer wall 94 of the channel contacts edges of the glass unit on both sides of the corner. The wall 94 between the legs 92 is deformed outwardly in the vicinity of the corner as shown in FIG. 14, and aligned orifices 96 are formed in the outwardly deformed portion to form a channel to receive the stretch cord 70. A stretch cord 70 that passes through the orifices 96, when elastically stretched, bears against the forwardly and upwardly facing walls 98 of the orifices 96 rather than against the glass panes or spacer. Note also that the outwardly deformed wall of the support block 90 has a groove 116 formed in its outer surface that runs parallel to the channel defined by the orifices 96. The groove 116 is formed to receive a stretch cord in a manner similar to the groove 82 of the support block depicted in FIG. 13. When an additional support block is needed (as when two corners of a glass unit are to be engaged by a stretch cord), the support block 90 may be employed, the cord running over and through the groove 116 rather than through the orifices 96. The material from which the support block 90 is made desirably is a somewhat rigid polymer such as polyethylene and as such is somewhat less resilient than the support block 80 described above which may be of a plastic foam such as polyurethane. Desirably, the surface of the support blocks are formed of a smooth polymer such as polyethylene to which sealants which may be used in the construction of a glass unit do not readily stick. As shown in FIGS. 21 and 22, a generally U-shaped sheath 115 may be employed to support the edges of a glass unit, to avoid having an elastic cord enter the space between glass panes, and (when large and small glass units are interleaved) to serve as a wedge between the confronting glass surfaces of adjacent glass units to more firmly support them and to limit side-to-side movement between the glass units. The sheath preferably is formed of a deformable polymeric material such as polyethylene. In cross section, as shown in FIG. 22, the sheath has parallel side walls 117 spaced to loosely confront the outer walls of the glass unit, the side walls having upper portions 119 that converge upwardly so that their inner surfaces contact the edges of the glass unit. A top wall 121 joins and supports the side walls.

An alternate but less preferred form of the invention is shown in FIG. 12. Here, a glass unit 2 is positioned in a container of the invention in the orientation shown in FIG. 1, but the stretch cord is differently positioned. In FIG. 12, a length of stretch cord is doubled back upon itself, and the ends of the stretch cord are secured at or near the intersection of the planes of the rear wall and the floor, e.g., to the rearward edge of the rear floor portion 34. A support block 102, similar to that shown in FIG. 13, is employed, the top groove 104 of the block extending at right angles to the bottom, glass unit-receiving groove 106. In this example, the stretch cord 100 passes through the groove 104 beneath the retaining strap 108. Force exerted by the stretch cord 100 has, as previously described, a force component tending to urge the glass unit rearwardly into contact with the rear wall and another component urging the glass unit downwardly into contact with the floor. To remove the stretch cord 100 from the glass unit, it is merely pulled upwardly and forwardly. Depending upon the length of the stretch cord 100, the stretch cord when unused can merely rest against the floor of the container.

Figure 15:
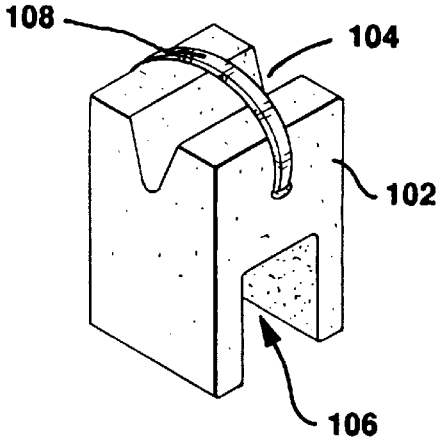
FIG. 15 is a perspective view of a support block similar to that of FIG. 13 but adapted for use with the device shown in FIG. 12.
Figure 17:
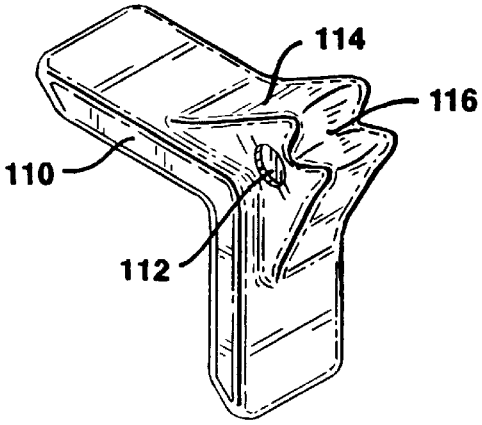
FIG. 17 is a perspective view of a support block similar to that of FIG. 14 but adapted for use with the device of FIG. 12.
Figure 16:
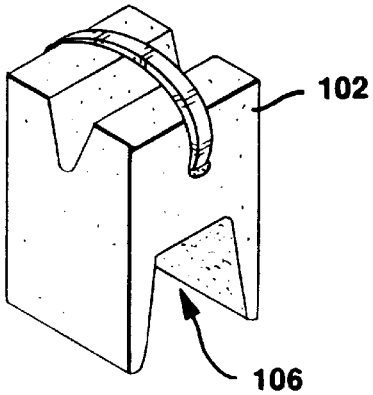
FIG. 16 is a perspective view of a modification of the support block of FIG. 15.

FIG. 16 shows a support block 102 similar to that of FIG. 15, but having a lower groove 106 having upwardly converging walls that urge the glass panes of a glass unit together. FIG. 17 shows a support block 110 similar to that shown in FIG. 14 but having the orifices 112 in the side of the elevated portion 114 for use in the embodiment shown in FIG. 12.

Although the container of the invention can be sized as desired, it has been found convenient to so dimension the container as to space the glass units center-to-center by approximately 1.25 inches. Referring to FIG. 13, the width of the bottom groove 84 may be on the order of 1 inch and the side-to-side width of the support block 80 should be approximately 1.25 inches. If glass units of the same size are positioned adjacent one another, then the support blocks will be transversely aligned and will touch one another, preventing substantially all transverse movement of the glass units with respect to each other. If glass panes of widely differing sizes are positioned adjacent to one another, then the sides of the support blocks may be spaced slightly from adjacent panes of other glass units, permitting slight but non-damaging transverse movement of the glass units with respect to each other. The force exerted by the stretch cords against the glass units need not be great in order to hold the glass units in place. Forces in the range of 5–20 pounds yield good results.

Thus, in the invention as described, each individual glass unit is independently urged against the rear wall and floor of the container by an elongated, elastic restraint, and releasing any giving elastic restraint permits the glass unit held by that restraint to be removed from the container. Yet, during shipping, each glass unit is prevented from moving to any appreciable extent from its position in which its edges are in supportive contact with the rear wall and floor.

What is claimed is:

1. A shipping container and a plurality of parallel panels supported therein, the container comprising a floor, a generally upright rear wall, and a frame supporting the floor and rear wall in planes that intersect at approximately a right angle for vertically supporting said plurality of parallel panels with edges of the panels being supported by the floor and the rear wall, respectively, the panels being supported in parallel planes that are perpendicular to the planes of the rear wall and the floor, and elastic restraining means comprising an elongated, elastic restraint positioned so as to encounter a panel and to elastically urge that panel towards said intersection.

2. The shipping container of claim 1 wherein said elongated elastic restraint extends generally in the plane of the panel to contact and elastically press against the upper, forward corner of the panel.

3. The shipping container of claim 1 wherein one end of the elastic restraint is anchored adjacent the top of the rear wall, the restraint extending downwardly and forwardly over and in contact with a panel with the other end of the restraint being attached to the floor forwardly of said panel.

4. The shipping container of claim 1 wherein said rear wall includes a panel contact surface comprising a plurality of spaced, generally vertically extending grooves shaped and sized to receive and support rearward edges of parallel panels.

5. The shipping container of claim 4 wherein said floor includes a floor panel comprising a plurality of spaced floor grooves aligned with said generally vertically extending grooves and shaped and sized to receive and support the bottom edges of parallel panels.

6. The shipping container of claim 5 wherein said floor panel comprises a floor portion and a plurality of blades rising from the floor portion and defining said floor groves, said floor including a strip of resilient material engaged by bottom edges of said panels in the container, the height of said strip being greater than the height of the floor panel between said blades, whereby the weight of said panels in the container is born primarily by said strip.

7. The shipping container of claim 6 (including a) wherein said strip of resilient material extends across the width of the floor generally parallel to the intersection of the rear wall and the floor.

8. The shipping container of claim 1 wherein said elongated elastic restraint includes along its length a support block adapted to contact the forward, upper corner of a panel to transmit force to the panel.

9. The shipping container of claim 8 wherein said support block includes a recess adapted to receive the forward, upper corner of the panel, the block having a width greater than the width of the panel to appropriately space and support the panel with respect to adjacent panels.

10. The shipping container of claim 8 wherein said support block includes outwardly converging walls defining a recess sized to encounter parallel edges of the panel and to press said edges toward each other.

11. The shipping container of claim 1 including a hinge permitting the floor and the rear wall to be folded toward each other.

12. The shipping container of claim 11 including a lock for locking the rear wall and floor at a right angle to each other to prevent the floor and rear wall from folding toward each other.

13. A shipping container for panels comprising a floor, a generally upright rear wall, and a frame supporting the floor and rear wall in planes that intersect at approximately a right angle for vertically supporting a plurality of parallel panels with edges of the panels being supported by the floor and the rear wall, respectively, with the panels supported in parallel planes that are perpendicular to the planes of the rear wall and the floor, an elastic restraining means comprising an elongated, elastic restraint positioned so as to encounter a panel and to elastically urge that panel towards said intersection, said restraint including along its length the support block adapted to contact the forward, upper corner of a panel to transmit force to the panel.

14. The shipping container of claim 13, wherein said support block includes a recess adapted to receive the forward, upper corner of the panel, the block having a width greater than the width of the panel to appropriately space and support the panel with respect to adjacent panels.

15. The shipping container of claim 13, wherein said support block includes outwardly converging walls defining a recess sized to encounter parallel edges of the panel and to press said edges toward each other.

* * * * *